United States Patent [19]

Donovan

[11] Patent Number: 4,557,475

[45] Date of Patent: Dec. 10, 1985

[54] CUSHIONED ACTIVITY SURFACE WITH CLOSED CELL FOAM PAD BONDED TO HARD SURFACE AND RUBBER MAT

[76] Inventor: James P. Donovan, 4975 N. Ardmore Ave., Whitefish Bay, Wis. 53217

[21] Appl. No.: 385,485

[22] Filed: Jun. 7, 1982

[51] Int. Cl.[4] ..... A63B 71/02

[52] U.S. Cl. ..... 272/3; 5/420; 52/177; 52/309.8; 267/152; 272/109; 404/32; 428/17; 428/314.4; 428/314.8; 428/316.6; 428/319.1

[58] Field of Search ..... 272/3, 4, 56.5 R, 56.5 SS, 272/65, 70, 100, 101, 102, 113, 1 R, 109, 144; 5/417, 420, 473, 474, 481; 52/309.12, 309.17, 390, 309.8, 314, 316, 555, 557, 558, 177; 428/54, 55, 56, 60, 64, 66, 77, 78, 80, 316.6, 17, 138, 314.4, 314.8, 319.1, 703; 404/17, 27, 31, 32, 33, 82; 267/152, 153, 145; 273/24 R, 411

[56] References Cited

U.S. PATENT DOCUMENTS

| | | | |
|---|---|---|---|
| 1,694,476 | 12/1928 | Lefebure | 52/390 |
| 2,191,465 | 2/1940 | Harshberger et al. | 52/558 |
| 2,977,864 | 4/1961 | Pullar | 404/32 X |
| 2,999,431 | 9/1961 | Mitchell | 404/32 X |
| 3,022,712 | 2/1962 | Cousino et al. | 404/17 X |
| 3,158,962 | 12/1964 | Faase | 52/390 X |
| 3,280,528 | 10/1966 | Dunlap, Jr. | 52/309.8 |
| 3,310,818 | 3/1967 | Fischer | 5/420 |
| 3,446,122 | 5/1969 | Raichle et al. | 272/3 |
| 3,464,178 | 9/1969 | Deichert et al. | 428/56 X |
| 3,518,707 | 7/1970 | Nissen | 5/420 |
| 3,661,687 | 5/1972 | Spinney, Jr. et al. | 272/3 X |
| 3,902,293 | 9/1975 | Witt et al. | 428/77 X |
| 3,919,443 | 11/1975 | Porter | 428/77 X |
| 4,073,753 | 2/1978 | Hauge | 404/32 X |
| 4,075,805 | 2/1978 | Bongiovanni | 52/309.12 |
| 4,082,888 | 4/1978 | Portin | 404/32 X |
| 4,283,456 | 8/1981 | Creasy | 428/316.6 X |
| 4,316,297 | 2/1982 | Geist | 5/420 |
| 4,323,231 | 4/1982 | Wilson | 272/65 |

FOREIGN PATENT DOCUMENTS

| | | | |
|---|---|---|---|
| 56808 | 12/1912 | Austria | 404/17 |
| 886152 | 11/1971 | Canada | 428/17 |
| 1910476 | 9/1970 | Fed. Rep. of Germany | 272/3 |
| 1914705 | 10/1970 | Fed. Rep. of Germany | 52/390 |
| 2257602 | 6/1974 | Fed. Rep. of Germany | 272/3 |
| 2621259 | 11/1977 | Fed. Rep. of Germany | 272/3 |
| 1316328 | 12/1962 | France | 404/32 |
| 2377498 | 9/1978 | France | 428/60 |
| 875891 | 8/1961 | United Kingdom | 404/32 |

*Primary Examiner*—Richard T. Stouffer
*Attorney, Agent, or Firm*—Bayard H. Michael

[57] ABSTRACT

An activity field is surfaced with a cushioned, resilient rubber mat over a hard undersurface. One area of the field is subject to participant impact potentially resulting in injury. That area is provided with a closed cell shock absorbing foam pad between the rubber mat and the hard undersurface to permit the mat to flex restrained by the foam pad to attenuate an impact. The rubber mat is bonded to the pad by a flexible adhesive and both the mat and the pad are bonded to said undersurface. The mat extends beyond the perimeter of the pad.

4 Claims, 5 Drawing Figures

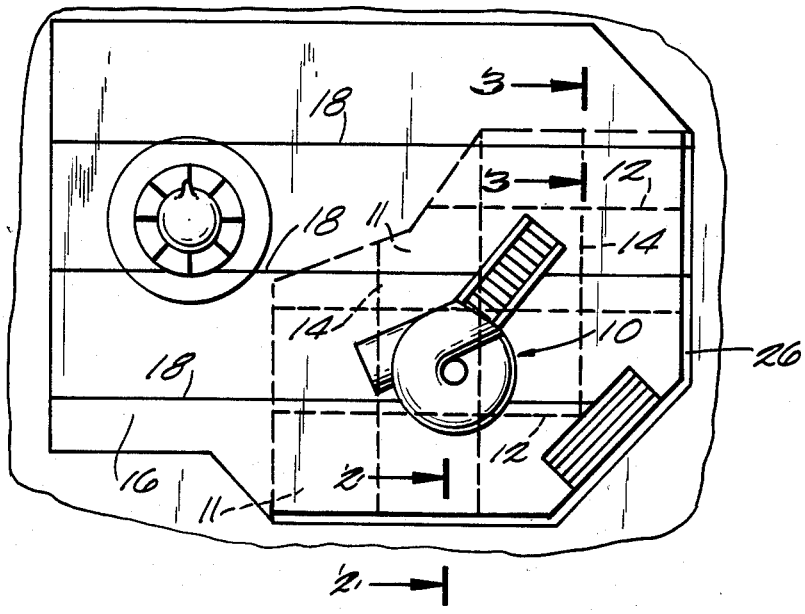
Fig. 1
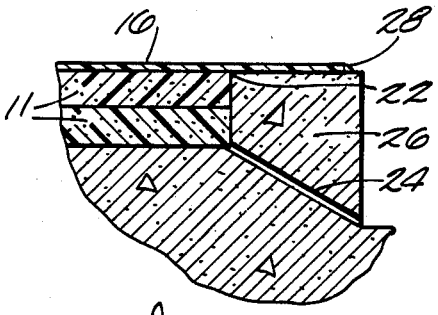
Fig. 2
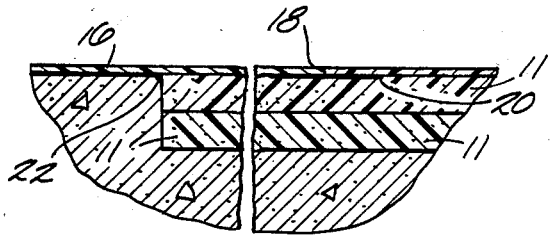
Fig. 3
Fig. 4
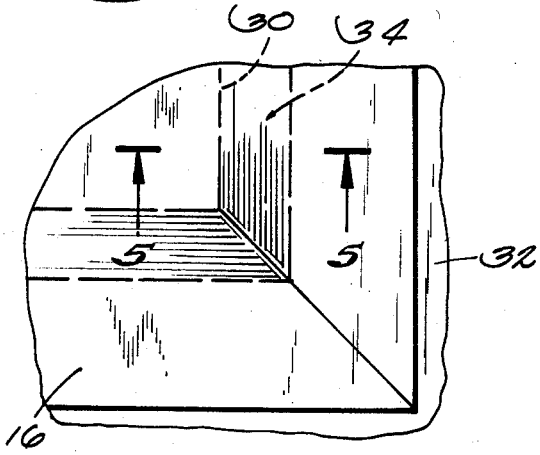
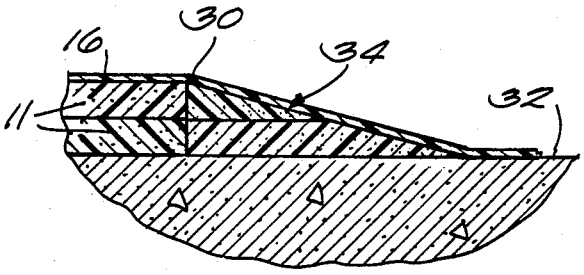
Fig. 5

CUSHIONED ACTIVITY SURFACE WITH CLOSED CELL FOAM PAD BONDED TO HARD SURFACE AND RUBBER MAT

BACKGROUND OF THE INVENTION

In the last few years certain fast food restaurants have installed outdoor playgrounds for use by their juvenile patrons. The most popular item in the area has been a spiral slide. Children can, and do, fall from the slide and this can result in injury . . . which, in contemporary America, means somebody gets sued. Similar problems beset public playgrounds. The U.S. Consumer Protection Commission established standards for protection from serious injury in a 10 foot fall. Up to now no surface (bark, sand, etc.) could meet the standards. In view of mounting litigation it appeared many playgrounds would be closed unless suitable protection could be devised.

SUMMARY OF THE INVENTION

The object of this invention is to provide a cushioned surface which meets and exceeds all known standards and can be used outdoors in a wide range of climatic conditions over a long time without loss of function or appearance. Another object is to provide for use in playgrounds and for sports, a surface which can be cushioned in selected areas where users may fall or drop from an appreciable height. The cushioned surface can be used to advantage in high jump landing areas and around pole vault landing pads in addition to the slide situation mentioned above. The transition from cushioned surface to uncushioned surface is effected so as to avoid potential hazards. The surface can withstand rain, sun, snow, ice and high temperature without adverse effect. The surface is good looking and is easily maintained.

I achieve these objectives through use of a closed cell foam of a specially modified PVC compounded with nitrile rubber to strengthen cell walls, producing a crosslinked polymer that will withstand repeated impact/recovery cycles. Such foam is sold for its shock absorption ability but it has never been used in the manner described herein. The surface is too fragile for the present use. I cover the foam with a rubber mat calendered and vulcanized with a base of polychloroprene rubber and mineral aggregates with stabilizing agents and pigments. The surface is weather resistant. The mat is bonded to concrete or asphalt to provide a slightly cushioned, resilient surface for various sports. It has never been used over a foam pad. I find it provides good protection for the foam and can withstand the flexure permitted by the foam.

The closed cell foam will not take up water and therefore is not damaged by freezing. Adequate drainage must be provided so the foam does not remain in water, however. The rubber mat will normally prevent passage of water to the foam but there may be leakage at joints or by reason of cuts or punctures. Thus, provision for drainage must be provided.

The foam should be bonded to the hard undersurface even if the foam is recessed into the surface. The rubber mat must be bonded to the foam and this adhesive must be flexible over a wide range of temperatures. The abutting mat edges should be constrained to move in unison to prevent separation from the foam and creation of an edge to trip over. A wide tape is bonded to the underside of adjacent mat strips along the abutting edges.

BRIEF DESCRIPTION OF THE DRAWINGS

FIG. 1 is a top plan view of a playground area in which certain areas are designed for impact resistance while other areas are simply covered with the rubber surface.

FIG. 2 is a detail showing the method of draining the recess in which the closed cell foam material is located.

FIG. 3 is a detail of the seam reinforcement.

FIG. 4 is a detail of the type of construction used when the foam is mounted on a flush surface, that is, not recessed, and FIG. 5 is a detail of the manner in which the transition is made with the construction in FIG. 4 and is a section taken on Line 5—5 in FIG. 4.

DETAILED DESCRIPTION OF THE DRAWINGS

Users may fall from the spiral slide 10. Accordingly, the shaded area around the slide is provided with cushioned safety surface. The entire playground in FIG. 1 is concrete. The shaded area is recessed to receive two, one inch thick closed cell foam pads 11 of specially modified PVC compounded with nitrile rubber to strengthen the cell walls and produce a cross-linked polymer that will withstand repeated impact/recovery cycles without adverse effect. Two, one inch pads are preferred to a single two inch pad from the handling and transportation standpoint and from the standpoint of minimizing the effect of the seams between the strips of foam. In the illustrated arrangement, one layer is layed with the edges running horizontally in the drawing and depicted by dotted lines 12 and the next layer is arranged at 90° to the first so the edges would be edge illustrated by dotted lines 14. The bottom pad is bonded to the undersurface, usually concrete or asphalt. The top pad should be bonded to the bottom pad.

The entire surface of the playground area shown in FIG. 1 is covered with a rubber mat 16 which is calendered and vulcanized with a base of polychloroprene rubber and mineral aggregates with stabilizing agents and pigments. This rubber mat is layed in strips with the abutting edges 18 being bonded to a six inch wide Nylon tape 20 which in turn is bonded to the foam pad as is the entire rubber mat. With the tape securing the edges together, the edges will move in unison and not separate creating a potential hazard. The mat edges 18 are at 90° to the edges 14 of the foam pad to which the mat is bonded.

The rubber mat extends beyond the foam pad in all directions as can be seen in FIG. 1 and is bonded to the concrete or asphalt surface. The corner of the concrete surrounding the recess is chamfered at 22 to minimize the wear of the underside of the mat resulting from flexure of the mat at the corners.

While, in theory, the closed cell foam pad does not take up water, it is not a good idea to let the pad remain submerged in water. In theory the rubber mat is waterproof and no water should penetrate to the recess in which the foam is mounted. However, leakage will likely occur during the life of the installation. Therefore, drain holes or tubes 24 are provided around the edges of the recess adjacent the curb 26. Additional drains can, if desired, be provided in a vertical attitude through the concrete into the aggregate underneath the concrete.

The perimeter of the rubber mat is preferably finished off by means of a bead 28 of conventional construction.

The arrangement illustrated in FIGS. 4 and 5 shows the foam mounted directly on a hard surface which is not recessed to receive the foam. Thus, in this case, the two, one inch pads are bonded to surface 32 and can terminate at line 30 with a fabricated foam bevel 34 surrounding the pads or the edges of the pads can be beveled on the job (which is difficult). The pads are at 90° to one another. The beveled foam extends about eight inches beyond the edge of the double thickness to achieve a reasonable transition from the raised surface to the portion where the rubber mat is directly in contact with and bonded to the concrete surface 32. It will be noted that in either the surface or recessed pad, the rubber mat extends beyond the perimeter of the pad and is bonded directly to the hard surface.

As can be seen in FIG. 4, the beveled pad 34 and the rubber mat are mitered at the corner to make a smooth neat joint. Nylon tape is bonded underneath the mitered joint in the rubber mat.

With this arrangement, a person can fall onto the composite pad (the pad made up of the closed cell foam and the rubber mat) from a height of 10 feet without sustaining injury. This construction meets the standards established by the U.S. Consumer Protection Agency, and to applicant's knowledge, this is the only surface treatment which does meet such standards.

I claim:

1. An activity field surfaced with a cushioned, resilient rubber surface over a hard undersurface, one area of said field being subject to participant impact potentially resulting in injury, such area being provided with a closed cell shock absorbing foam pad between the rubber surface and the hard undersurface to permit the rubber surface to flex restrained by the foam pad to attenuate an impact, said surface being a mat bonded to the pad by a flexible adhesive and both the mat and the pad being bonded to said undersurface, said surface extending in all directions beyond the perimeter of the pad, said foam pad being a plurality of strips of closed cell foam and said mat being made up from a plurality of strips laid so as to avoid vertical alignment of joints in the mat with joints in the foam pad to which the mat is bonded.

2. A cushioned play and sport surface for use in areas likely to be impacted by users, comprising, a hard surface, a closed cell foam pad bonded to the hard surface, said foam pad being a compound of modified PVC with nitrile rubber, a resilient, cushioned rubber mat bonded to the foam pad, said mat being calendered and vulcanized with a base of polychloroprene rubber and mineral aggregates with stabilizing agents.

3. A cushioned play and sport surface for use in areas likely to be impacted by users, comprising, a hard surface, a closed cell foam pad recessed into said hard surface and bonded to said hard surface, a resilient, cushioned rubber mat bonded to said foam pad and extending beyond the pad, said foam pad being a plurality of strips of closed cell foam and said mat being made up from a plurality of strips laid so as to avoid vertical alignment of joints in the mat with joints in the foam pad to which the mat is bonded, said mat being level across the padded and unpadded areas.

4. A cushioned play and sport surface for use in areas likely to be impacted by users, comprising, a hard surface, a closed cell foam pad bonded to the hard surface, a resilient, cushioned rubber mat bonded to the foam pad, said foam pad being a plurality of strips of closed cell foam and said mat being made up from a plurality of strips laid so as to avoid vertical alignment of joints in the mat with joints in the foam pad to which the mat is bonded, said mat extending beyond said pad, the perimeter of said foam pad being beveled to achieve a transition to the unpadded mat, said mat being mitered to lie smoothly on the beveled corners.

* * * * *